US009263167B2

(12) United States Patent
Yoshida et al.

(10) Patent No.: US 9,263,167 B2
(45) Date of Patent: Feb. 16, 2016

(54) ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

(71) Applicants: FURUKAWA ELECTRIC CO., LTD., Tokyo (JP); FURUKAWA AUTOMOTIVE SYSTEMS INC., Inukami-gun, Shiga (JP)

(72) Inventors: Sho Yoshida, Tokyo (JP); Shigeki Sekiya, Tokyo (JP); Kyota Susai, Tokyo (JP); Kengo Mitose, Tokyo (JP)

(73) Assignees: FURUKAWA ELECTRIC CO., LTD., Tokyo (JP); FURUKAWA AUTOMOTIVE SYSTEMS INC., Inukami-Gun, Shiga (JP)

( * ) Notice: Subject to any disclaimer, the term of this patent is extended or adjusted under 35 U.S.C. 154(b) by 0 days.

(21) Appl. No.: 14/681,731

(22) Filed: Apr. 8, 2015

(65) Prior Publication Data

US 2015/0213913 A1 Jul. 30, 2015

Related U.S. Application Data

(63) Continuation of application No. PCT/JP2013/080957, filed on Nov. 15, 2013.

(30) Foreign Application Priority Data

Mar. 29, 2013 (JP) ..... 2013-075401

(51) Int. Cl.
*H01B 1/02* (2006.01)
*C22F 1/00* (2006.01)

(Continued)

(52) U.S. Cl.
CPC ..... *H01B 1/023* (2013.01); *C22C 21/02* (2013.01); *C22C 21/04* (2013.01); *C22C 21/08* (2013.01);

(Continued)

(58) Field of Classification Search
CPC ..... H01B 3/30; H01B 7/0045
USPC ..... 174/74 R; 248/372
See application file for complete search history.

(56) References Cited

U.S. PATENT DOCUMENTS

2006/0013719 A1* 1/2006 Ichikawa ..... C22C 21/10 419/29

(Continued)

FOREIGN PATENT DOCUMENTS

JP 4986251 B2 7/2012
JP 2012-229485 A 11/2012

(Continued)

OTHER PUBLICATIONS

Decision to Grant a Patent 2014-508613 dated Aug. 11, 2014.

(Continued)

*Primary Examiner* — Timothy Thompson
*Assistant Examiner* — Krystal Robinson
(74) *Attorney, Agent, or Firm* — Birch, Stewart, Kolasch & Birch, LLP

(57) ABSTRACT

An aluminum alloy wire rod has a composition consisting of Mg: 0.10 to 1.00 mass %, Si: 0.10 to 1.00 mass %, Fe: 0.01 to 2.50 mass %, Ti: 0.000 to 0.100 mass %, B: 0.000 to 0.030 mass %, Cu: 0.00 to 1.00 mass %, Ag: 0.00 to 0.50 mass %, Au: 0.00 to 0.50 mass %, Mn: 0.00 to 1.00 mass %, Cr: 0.00 to 1.00 mass %, Zr: 0.00 to 0.50 mass %, Hf: 0.00 to 0.50 mass %, V: 0.00 to 0.50 mass %, Sc: 0.00 to 0.50 mass %, Co: 0.00 to 0.50 mass %, Ni: 0.00 to 0.50 mass %, and the balance: Al and incidental impurities. The aluminum alloy wire rod has an average grain size of 1 μm to 35 μm at an outer peripheral portion thereof, and an average grain size at an inner portion thereof is greater than or equal to 1.1 times the average grain size at the outer peripheral portion.

13 Claims, 2 Drawing Sheets

(51) Int. Cl.

| | |
|---|---|
| ***C22F 1/04*** | (2006.01) |
| ***C22C 21/02*** | (2006.01) |
| ***C22C 21/08*** | (2006.01) |
| ***C22C 21/04*** | (2006.01) |
| ***C22F 1/043*** | (2006.01) |
| ***C22F 1/047*** | (2006.01) |
| ***C22F 1/05*** | (2006.01) |
| ***H01B 3/30*** | (2006.01) |
| ***H01B 7/00*** | (2006.01) |
| ***H01B 13/00*** | (2006.01) |

(52) U.S. Cl.

CPC ... *C22F 1/00* (2013.01); *C22F 1/04* (2013.01); *C22F 1/043* (2013.01); *C22F 1/047* (2013.01); *C22F 1/05* (2013.01); *H01B 1/02* (2013.01); *H01B 3/30* (2013.01); *H01B 7/0045* (2013.01); *H01B 13/0006* (2013.01); *H01B 13/0016* (2013.01)

(56) References Cited

U.S. PATENT DOCUMENTS

2007/0221396 A1* 9/2007 Izumida ..... C21D 8/06 174/128.1
2010/0059151 A1* 3/2010 Iwamura ..... C22C 21/12 148/690
2012/0321889 A1* 12/2012 Sekiya ..... C22C 21/00 428/372
2013/0264115 A1* 10/2013 Kobayashi ..... H01B 1/023 174/72 A

FOREIGN PATENT DOCUMENTS

JP 2013-044039 A 3/2013
JP 5155464 B2 3/2013

OTHER PUBLICATIONS

International Search Report issued in PCT/JP2013/080957 dated Feb. 4, 2014.
Notification of Reason for Refusal 2014-508613 dated May 19, 2014.
Written Opinion of the International Searching Authority issued in PCT/JP2013/080957 dated Feb. 4, 2014.
English translation of International Preliminary Report on Patentability dated Sep. 29, 2015, issued in PCT/JP2013/080957 (Form PCT/IB/373).
English translation of Written Opinion of the International Searching Authority dated Feb. 4, 2014, and issued Sep. 29, 2015 in PCT/JP2013/080957 (Form PCT/ISA/237).

* cited by examiner

ALUMINUM ALLOY WIRE ROD, ALUMINUM ALLOY STRANDED WIRE, COATED WIRE, WIRE HARNESS AND MANUFACTURING METHOD OF ALUMINUM ALLOY WIRE ROD

CROSS REFERENCE TO RELATED APPLICATIONS

This is a continuation application of International Patent Application No. PCT/JP2013/080957 filed Nov. 15, 2013, which claims the benefit of Japanese Patent Application No. 2013-075401, filed Mar. 29, 2013, the full contents of all of which are hereby incorporated by reference in their entirety.

BACKGROUND

1. Technical Field

The present disclosure relates to an aluminum alloy conductor used as a conductor of an electric wiring structure, and particularly relates to an aluminum alloy conductor that provides high conductivity, high bending fatigue resistance, appropriate proof stress, and also high elongation, even as an extra fine wire.

2. Background

In the related art, a so-called wire harness has been used as an electric wiring structure for transportation vehicles such as automobiles, trains, and aircrafts, or an electric wiring structure for industrial robots. The wire harness is a member including electric wires each having a conductor made of copper or copper alloy and fitted with terminals (connectors) made of copper or copper alloy (e.g., brass). With recent rapid advancements in performances and functions of automobiles, various electrical devices and control devices installed in vehicles tend to increase in number and electric wiring structures used for devices also tends to increase in number. On the other hand, for environmental friendliness, lightweighting is strongly desired for improving fuel efficiency of transportation vehicles such as automobiles.

As one of the measures for achieving recent lightweighting of transportation vehicles, there have been, for example, continuous efforts in the studies of changing a conductor of an electric wiring structure to aluminum or aluminum alloys, which is more lightweight than conventionally used copper or copper alloys. Since aluminum has a specific gravity of about one-third of a specific gravity of copper and has a conductivity of about two-thirds of a conductivity of copper (in a case where pure copper is a standard for 100% IACS, pure aluminum has approximately 66% IACS), a pure aluminum conductor wire rod needs to have a cross sectional area of approximately 1.5 times greater than that of a pure copper conductor wire rod to allow the same electric current as the electric current flowing through the pure copper conductor wire rod to flow through the pure aluminum conductor wire rod. Even an aluminum conductor wire rod having an increased cross section as described above is used, using an aluminum conductor wire rod is advantageous from the viewpoint of lightweighting, since an aluminum conductor wire rod has a mass of about half the mass of a pure copper conductor wire rod. Note that, "% IACS" represents a conductivity when a resistivity $1.7241\times10^{-8}$ Ωm of International Annealed Copper Standard is taken as 100% IACS.

However, it is known that pure aluminum, typically an aluminum alloy conductor for transmission lines (JIS (Japanese Industrial Standard) A1060 and A1070), is generally poor in its durability to tension, resistance to impact, and bending characteristics. Therefore, for example, it cannot withstand a load abruptly applied by an operator or an industrial device while being installed to a car body, a tension at a crimp portion of a connecting portion between an electric wire and a terminal, and a cyclic stress loaded at a bending portion such as a door portion. On the other hand, an alloyed material containing various additive elements added thereto is capable of achieving an increased tensile strength, but a conductivity may decrease due to a solution phenomenon of the additive elements into aluminum, and because of excessive intermetallic compounds formed in aluminum, a wire break due to the intermetallic compounds may occur during wire drawing. Therefore, it is essential to limit or select additive elements to provide sufficient elongation characteristics to prevent a wire break, and it is further necessary to improve impact resistance and bending characteristics while ensuring a conductivity and a tensile strength equivalent to those in the related art.

Japanese Laid-Open Patent Publication No. 2012-229485 discloses a typical aluminum conductor used for an electric wiring structure of the transportation vehicle. Disclosed therein is an extra fine wire that can provide an aluminum alloy conductor and an aluminum alloy stranded wire having a high strength and a high conductivity, as well as an improved elongation. Also, Japanese Laid-Open Patent Publication No. 2012-229485 discloses that sufficient elongation results in improved bending characteristics. However, for example, it is neither disclosed nor suggested to use an aluminum alloy wire as a wire harness attached to a door portion, and there is no disclosure or suggestion about bending fatigue resistance under an operating environment in which high cycle fatigue fracture is likely to occur due to repeated bending stresses exerted by opening and closing of the door.

Recently, it is recognized that the following three problems arise when manufacturing an aluminum alloy conductor used for automobiles, particularly an aluminum alloy conductor of around ϕ0.1 mm to ϕ1.5 mm. The first problem is that, as has been described above, a high bending fatigue resistance is required when used at a repeatedly bent portion such as a door portion of an automobile. Aluminum has a poor bending fatigue characteristics as compared to currently used copper, and thus locations where it can be used is limited. The second problem is that since it has a high proof stress, installation of a wire harness requires a large force, and a work efficiency is low. The third problem is that since it has a low elongation, it cannot withstand an impact during the installation of a wire harness or after installation, and thus wire breaks and cracks could occur. In order to solve all of these problems, an aluminum alloy wire is required that has a high conductivity as a prerequisite, as well as a high bending fatigue resistance, an appropriate proof stress and a high elongation.

As high strength-high conductivity aluminum alloys, those alloys with Mg, Si, Cu, and Mn added therein are known. For example, Japanese Patent No. 5155464 discloses that adding such elements gives a tensile strength of greater than or equal to 150 MPa and a conductivity of greater than or equal to 40%. Also, Japanese Patent No. 5155464 discloses that an elongation of greater than or equal to 5% is achieved simultaneously by manufacturing a wire rod having a maximum grain size of less than or equal to 50 μm.

However, the aluminum alloy conductor disclosed in Japanese Patent No. 5155464 cannot provide a high bending fatigue resistance and an appropriate proof stress in addition to a high conductivity and high elongation, and thus the three problems described above cannot be solved simultaneously.

The present disclosure is related to providing an aluminum alloy conductor, an aluminum alloy stranded wire, a coated wire, and a wire harness and to provide a method of manufacturing aluminum alloy conductor that provide both an appropriate proof stress and a high bending fatigue resistance while maintaining an elongation and a conductivity equivalent or higher than those of the related art.

The present inventors have found that when an aluminum alloy conductor is bent, a stress occurring at an outer peripheral portion of the conductor is greater than a stress occurring at a central portion, and cracks are likely to occur in an outer peripheral surface. Thus, the present inventors have focused on the fact that, for an aluminum alloy having a smaller grain size, a crack collides with grain boundaries for a greater number of times and thus advances at a reduced advancement rate. The present inventors carried out assiduous studies and found that when an average grain size at an outer peripheral portion of an aluminum alloy conductor takes a value within a predetermined range, an improved bending fatigue resistance is obtained and an appropriate proof stress and a high elongation are further achieved, while ensuring a high conductivity, and contrived the present disclosure.

SUMMARY

According to a first aspect of the present disclosure, an aluminum alloy wire rod has a composition consisting of Mg: 0.10 mass % to 1.00 mass %, Si: 0.10 mass % to 1.00 mass %, Fe: 0.01 mass % to 2.50 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein the aluminum alloy wire rod has an average grain size of 1 μm to 35 μm at an outer peripheral portion thereof, and an average grain size at an inner portion thereof is greater than or equal to 1.1 times the average grain size at the outer peripheral portion.

According to a second aspect of the present disclosure, a wire harness comprising a coated wire including a coating layer at an outer periphery of one of an aluminum alloy wire rod and an aluminum alloy stranded wire and a terminal fitted at an end portion of the coated wire, the coating layer being removed from the end portion, wherein the aluminum alloy wire rod has a composition consisting of Mg: 0.10 mass % to 1.00 mass %, Si: 0.10 mass % to 1.00 mass %, Fe: 0.01 mass % to 2.50 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein the aluminum alloy wire rod has an average grain size of 1 μm to 35 μm at an outer peripheral portion thereof, and an average grain size at an inner portion thereof is greater than or equal to 1.1 times the average grain size at the outer peripheral portion.

According to a third aspect of the present disclosure, a method of manufacturing an aluminum alloy wire rod according to the first aspect of the disclosure, the aluminum alloy wire rod being obtained by carrying out a melting process, a casting process, hot or cold working, a first wire drawing process, an intermediate heat treatment, a second wire drawing process, a solution heat treatment and an aging heat treatment in this order, wherein, in the first wire drawing process, a die used has a die half angle of 10° to 30° and a reduction ratio per pass of less than or equal to 10%, and in the second wire drawing process, a die used has a die half angle of 10° to 30° and a reduction ratio per pass of less than or equal to 10%.

The aluminum alloy conductor of the present disclosure has a conductivity which is equivalent to or higher than that of the related art and thus it is useful as a conducting wire for a motor, a battery cable, or a harness equipped on a transportation vehicle. Particularly, since it has a high bending fatigue resistance, it can be used at a bending portion requiring high bending fatigue resistance such as a door portion or a trunk. Further, since it has an appropriate proof stress, a wire harness can be attached with a small external force and thus an improved working efficiency is obtained. Further, since it has an elongation equivalent to or higher than that of the related art, it can withstand an impact during or after installation of a wire harness, and thus occurrence of wire breaks and cracks can be reduced.

DETAILED DESCRIPTION

Figure 1:
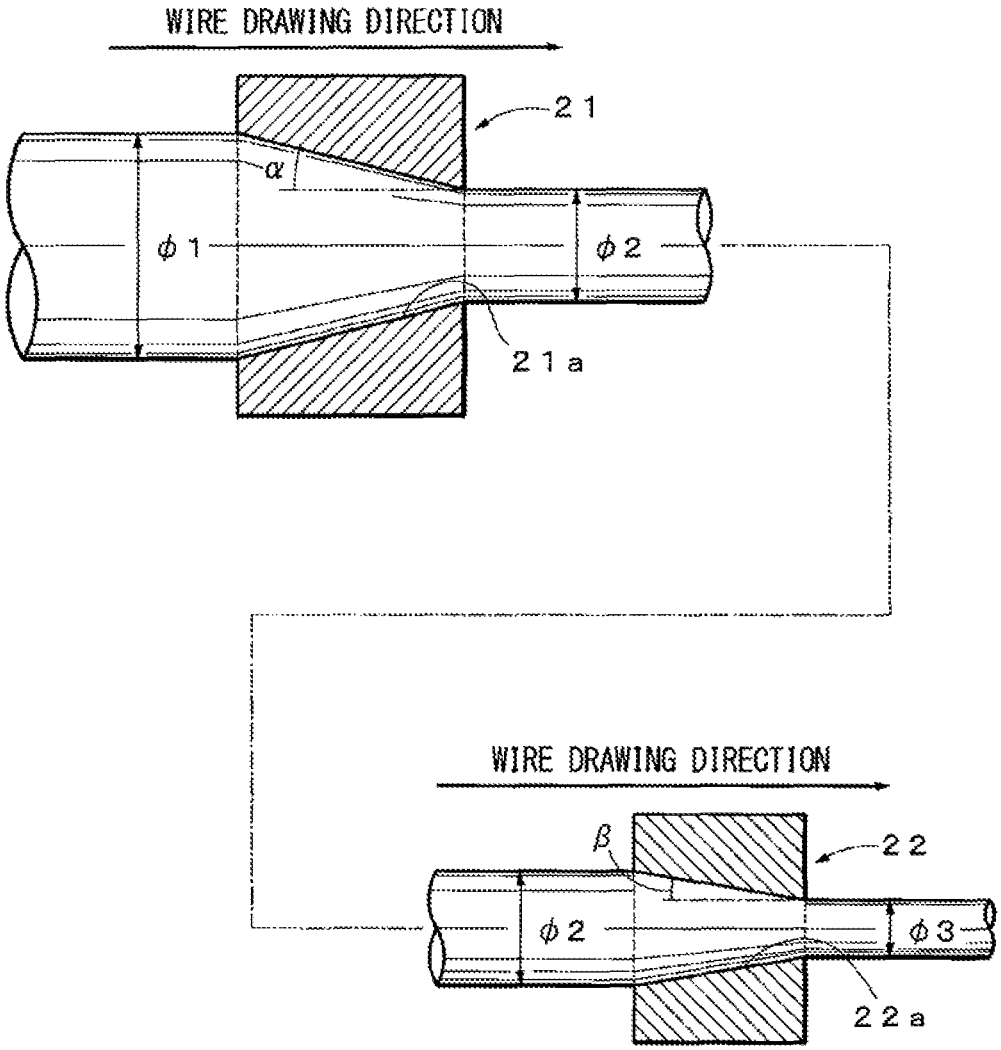
FIG. 1 is diagram for explaining a first wire drawing process and a second wire drawing process of the present disclosure.

Further features of the present disclosure will become apparent from the following detailed description of exemplary embodiments with reference to the accompanying drawings.

An aluminum alloy conductor of the present disclosure has a composition consisting of Mg: 0.10 mass % to 1.00 mass %, Si: 0.10 mass % to 1.00 mass %, Fe: 0.01 mass % to 2.50 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein the aluminum alloy conductor has an average grain size of 1 μm to 35 μm at an outer peripheral portion thereof.

Hereinafter, reasons for limiting chemical compositions or the like of the aluminum alloy conductor of the present disclosure will be described.

(1) Chemical Composition

<Mg: 0.10 Mass % to 1.00 Mass %>

Mg (magnesium) is an element having a strengthening effect by forming a solid solution with an aluminum base material and a part thereof having an effect of improving a tensile strength, a bending fatigue resistance and a heat resistance by being combined with Si to form precipitates. However, in a case where Mg content is less than 0.10 mass %, the above effects are insufficient. In a case where Mg content exceeds 1.00 mass %, there is an increased possibility that an Mg-concentration part will be formed on a grain boundary, thus resulting in decreased tensile strength, elongation, and bending fatigue resistance, as well as a reduced conductivity due to an increased amount of Mg element forming the solid solution. Accordingly, the Mg content is 0.10 mass % to 1.00 mass %. The Mg content is, when a high strength is of importance, preferably 0.50 mass % to 1.00 mass %, and in case where a conductivity is of importance, preferably 0.10 mass % to 0.50 mass %. Based on the points described above, 0.30 mass % to 0.70 mass % is generally preferable.

<Si: 0.10 Mass % to 1.00 Mass %>

Si (silicon) is an element that has an effect of improving a tensile strength, a bending fatigue resistance and a heat resistance by being combined with Mg to form precipitates. However, in a case where Si content is less than 0.10 mass %, the above effects are insufficient. In a case where Si content exceeds 1.00 mass %, there is an increased possibility that an Si-concentration part will be formed on a grain boundary, thus resulting in decreased tensile strength, elongation, and bending fatigue resistance, as well as a reduced conductivity due to an increased amount of Si element forming the solid solution. Accordingly, the Si content is 0.10 mass % to 1.00 mass %. The Si content is, when a high strength is of importance, preferably 0.5 mass % to 1.0 mass %, and in case where a conductivity is of importance, preferably 0.10 mass % to 0.50 mass %. Based on the points described above, 0.30 mass % to 0.70 mass % is generally preferable.

<Fe: 0.01 Mass % to 2.50 Mass %>

Fe (iron) is an element that contributes to refinement of crystal grains mainly by forming an Al—Fe based intermetallic compound and provides improved tensile strength and bending fatigue resistance. Fe dissolves in Al only by 0.05 mass % at 655° C. and even less at room temperature. Accordingly, the remaining Fe that could not dissolve in Al will be crystallized or precipitated as an intermetallic compound such as Al—Fe, Al—Fe—Si, and Al—Fe—Si—Mg. This intermetallic compound contributes to refinement of crystal grains and provides improved tensile strength and bending fatigue resistance. Further, Fe has, also by Fe that has dissolved in Al, an effect of providing an improved tensile strength. In a case where Fe content is less than 0.01 mass %, those effects are insufficient. In a case where Fe content exceeds 2.50 mass %, a wire drawing workability worsens due to coarsening of crystallized materials or precipitates and a wire break is likely to occur during the wire drawing. Also, a target bending fatigue resistance cannot be achieved and a conductivity decreases. Therefore, Fe content is 0.01 mass % to 2.50 mass %, and preferably 0.15 mass % to 0.90 mass %, and more preferably 0.15 mass % to 0.45 mass %. Note that, although in a case where Fe is excessive, a wire drawing workability worsens due to coarsening of crystallized materials or precipitates, and, as a result, a wire break is likely to occur, the present disclosure, since reduction ratio per pass is made low in the present disclosure at less than or equal to 10%, the tension during wire drawing is suppressed and a wire break is less likely to occur. Thus, Fe can be contained by a large amount and can be contained up to 2.50 mass %.

The aluminum alloy conductor of the present disclosure includes Mg, Si and Fe as essential components, and may further contain at least one selected from a group consisting of Ti and B, and/or at least one selected from a group consisting of Cu, Ag, Au, Mn, Cr, Zr, Hf, V, Sc, Co and Ni, as necessary.

<Ti: 0.001 Mass % to 0.100 Mass %>

Ti is an element having an effect of refining the structure of an ingot during dissolution casting. In a case where an ingot has a coarse structure, the ingot may crack during casting or a wire break may occur during a wire rod processing step, which is industrially undesirable. In a case where Ti content is less than 0.001 mass %, the aforementioned effect cannot be achieved sufficiently, and in a case where Ti content exceeds 0.100 mass %, the conductivity tends to decrease. Accordingly, the Ti content is 0.001 mass % to 0.100 mass %, preferably 0.005 mass % to 0.050 mass %, and more preferably 0.005 mass % to 0.030 mass %.

<B: 0.001 Mass % to 0.030 Mass %>

Similarly to Ti, B is an element having an effect of refining the structure of an ingot during dissolution casting. In a case where an ingot has a coarse structure, the ingot may crack during casting or a wire break is likely to occur during a wire rod processing step, which is industrially undesirable. In a case where B content is less than 0.001 mass %, the aforementioned effect cannot be achieved sufficiently, and in a case where B content exceeds 0.030 mass %, the conductivity tends to decrease. Accordingly, the B content is 0.001 mass % to 0.030 mass %, preferably 0.001 mass % to 0.020 mass %, and more preferably 0.001 mass % to 0.010 mass %.

To contain at least one selected from a group consisting of <Cu: 0.01 mass % to 1.00 mass %>, <Ag: 0.01 mass % to 0.50 mass %>, <Au: 0.01 mass % to 0.50 mass %>, <Mn: 0.01 mass % to 1.00 mass %>, <Cr: 0.01 mass % to 1.00 mass %>, <Zr: 0.01 mass % to 0.50 mass %>, <Hf: 0.01 mass % to 0.50 mass %>, <V: 0.01 mass % to 0.50 mass %>, <Sc: 0.01 mass % to 0.50 mass %>, <Co: 0.01 mass % to 0.50 mass %>, and <Ni: 0.01 mass % to 0.50 mass %>.

Each of Cu, Ag, Au, Mn, Cr, Zr, Hf, V, Sc, Co and Ni is an element having an effect of refining crystal grains, and Cu, Ag and Au are elements further having an effect of increasing a grain boundary strength by being precipitated at a grain boundary. In a case where at least one of the elements described above is contained by 0.01 mass % or more, the aforementioned effects can be achieved and a tensile strength, an elongation, and a bending fatigue resistance can be further improved. On the other hand, in a case where any one of Cu, Ag, Au, Mn, Cr, Zr, Hf, V, Sc, Co and Ni has a content exceeding the upper limit thereof mentioned above, a conductivity tends to decrease. Therefore, ranges of contents of Cu, Ag, Au, Mn, Cr, Zr, Hf, V, Sc, Co and Ni are the ranges described above, respectively.

The more the contents of Fe, Ti, B, Cu, Ag, Au, Mn, Cr, Zr, Hf, V, Sc, Co and Ni, the lower the conductivity tends to be and the more the wire drawing workability tends to deteriorate. Therefore, it is preferable that a sum of the contents of the elements is less than or equal to 2.50 mass %. With the aluminum alloy conductor of the present disclosure, since Fe is an essential element, the sum of contents of Fe, Ti, B, Cu, Ag, Au, Mn, Cr, Zr, Hf, V, Sc, Co and Ni is 0.01 mass % to 2.50 mass %. It is further preferable that the sum of contents of these elements is 0.10 mass % to 2.50 mass %.

In order to improve the tensile strength, the elongation, and the bending fatigue resistance while maintaining a high conductivity, the sum of contents of Fe, Ti, B, Cu, Ag, Au, Mn, Cr, Zr, Hf, V, Sc, Co and Ni is particularly preferably 0.10 mass % to 0.80 mass %, and further preferably 0.20 mass % to 0.60 mass %. On the other hand, in order to further improve the tensile strength, the elongation, and the bending fatigue resistance, although the conductivity will slightly decrease, it is particularly preferably more than 0.80 mass % to 2.50 mass %, and further preferably 1.00 mass % to 2.50 mass %.

<Balance: Al and Incidental Impurities>

The balance, i.e., components other than those described above, includes Al (aluminum) and incidental impurities. Herein, incidental impurities means impurities contained by an amount which could be contained inevitably during the manufacturing process. Since incidental impurities could cause a decrease in conductivity depending on a content thereof, it is preferable to suppress the content of the incidental impurities to some extent considering the decrease in the conductivity. Components that may be incidental impurities include, for example, Ga, Zn, Bi, and Pb.

Figure 2:
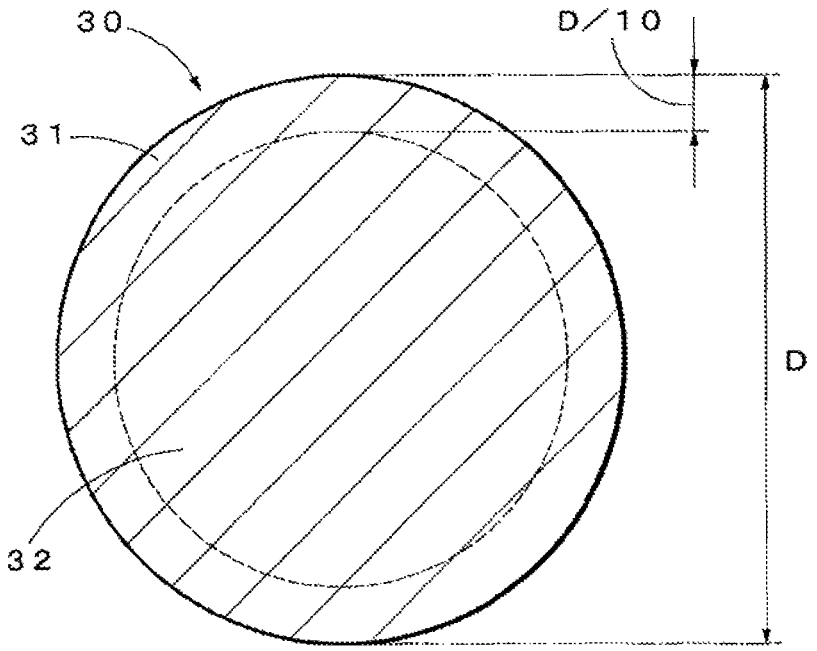
FIG. 2 is a cross sectional diagram of an aluminum alloy conductor showing a cross section perpendicular to a wire drawing direction.

(2) Aluminum Alloy Conductor has an Average Grain Size of 1 μm to 35 μm at an Outer Peripheral Portion Thereof An outer peripheral portion as used herein means a region in the vicinity of an outer edge of the aluminum alloy conductor and including the outer edge of the aluminum alloy conductor. In the case of an aluminum alloy conductor having a circular cross section perpendicular to a wire drawing direction, the outer peripheral portion is a region that includes an outer edge of the aluminum alloy conductor and having a width of 1/10 of the diameter of the aluminum alloy conductor from the outer edge (see FIG. 2). In the case of an aluminum alloy conductor having a non-circular cross section, such as a compressed stranded wire, first, an equivalent circle diameter is determined from the cross section of the aluminum alloy conductor. Then, a region including an outer edge of the aluminum alloy conductor and having a width of 1/10 of the circle equivalent diameter of the aluminum alloy conductor from the outer edge is defined as an outer peripheral portion.

According to the present disclosure, an average grain size at the outer peripheral portion is 1 μm to 35 μm. In a case where the average grain size is less than 1 μm, a proof stress is excessive and an elongation is reduced. In a case where an average grain size is greater than 35 μm, the bending fatigue resistance and the proof stress are reduced. Therefore, an average grain size at the outer peripheral portion is 1 μm to 35 μm, and preferably 3 μm to 30 μm, and more preferably 5 μm to 20 μm.

Also, an average grain size at a part other than the outer peripheral portion of the aluminum alloy conductor, i.e., an inner portion, is 1 μm to 90 μm. When an average grain size at the inner portion is less than 1 μm, the proof stress is excessive and the elongation decreases, and when the grain size at the inner portion is greater than 90 μm, sufficient elongation and proof stress cannot be obtained. The average grain size of the present disclosure was observed by an optical microscope and measured using a tolerance method.

(Manufacturing Method of the Aluminum Alloy Conductor of the Present Disclosure)

The aluminum alloy conductor of the present disclosure can be manufactured through each process including [1] melting process, [2] casting process, [3] hot or cold working, [4] first wire drawing process, [5] intermediate heat treatment, [6] second wire drawing process, [7] solution heat treatment and the first strain process, and [8] aging heat treatment and second strain process. Note that a bundling step or a wire resin-coating step may be provided before or after the solution heat treatment or the first strain process or after the aging heat treatment. Hereinafter, steps of [1] to [8] will be described.

[1] Melting Process

Melting is performed with such quantities that provide concentrations in respective embodiments of aluminum alloy compositions described below.

[2] Casting Process and [3] Hot or Cold Working

Using a Properzi-type continuous casting rolling mill which is an assembly of a casting wheel and a belt, molten metal is cast with a water-cooled mold and rolled into a bar. At this time, the bar is made into a size of, for example, around ϕ5.0 mm to ϕ13.0 mm. A cooling rate during casting at this time is, in regard to preventing coarsening of Fe-based crystallized products and preventing a decrease in conductivity due to forced solid solution of Fe, preferably 1° C./s to 20° C./s, but it is not limited thereto. Casting and hot rolling may be performed by billet casting and an extrusion technique.

[4] First Wire Drawing Process

Subsequently, the surface is stripped and the bar is made into a size of, for example, ϕ5.0 mm to ϕ12.5 mm, and wire drawing is performed by die drawing using a die 21 as shown in FIG. 1. By this wire drawing process, a diameter of a work piece is, for example, reduced to ϕ2.0 mm. It is preferable that the die 21 has a die half angle α of 10° to 30°, and a reduction ratio per pass is less than or equal to 10%. The reduction ratio is obtained by dividing a difference in cross section before and after the wire drawing by the original cross section and multiplying by 100. However, when the reduction ratio is extremely small, since the number of times of wire drawing for processing into a target wire size increases and productivity decreases, it is preferably greater than or equal to 1%. Also, when the reduction ratio is greater than 10%, since the wire drawing process is likely to become uniform inside and outside the wire rod, it is difficult to produce a difference in grain size at the outer peripheral portion and the inner portion, and there is a tendency that the proof stress cannot be reduced appropriately and the elongation cannot be improved. Further, providing an appropriate surface roughness to a tapered surface 21*a* of the die 21 is advantageous in that treatment can be applied on a surface of a work piece during the wire drawing. In this first wire drawing process, the stripping of the bar surface is performed first, but the stripping of the bar surface does not need to be performed.

[5] Intermediate Heat Treatment

Subsequently, an intermediate heat treatment is applied on the cold-drawn work piece. In the intermediate heat treatment of the present disclosure, the heating temperature of an intermediate annealing is 250° C. to 450° C., and the heating time is from ten minutes to six hours. If the heating temperature is lower than 250° C., a sufficient softening cannot be achieved and deformation resistance increases, and thus a wire break and a surface flaw are likely to occur during wire drawing. If it is higher than 450° C., coarsening of the grains is likely to occur, and the elongation and the strength (proof stress or tensile strength) will decrease.

[6] Second Wire Drawing Process

Further, wire drawing of the work piece is performed by die drawing using a die 22 as shown in FIG. 1. By this wire drawing, an outer diameter of the work piece is reduced to, for example, ϕ0.31 mm. It is preferable that the die 22 has a die half angle β of 10° to 30°, and a reduction ratio per pass is less than or equal to 10%. When the die half angle is in a range described above, it is advantageous in that a surface reduction ratio is increased, and it is possible to process the outer peripheral portion only. Also, it is desirable to increase the stress on the surface by roughening the tapered surface in the first wire drawing step, and to smooth the tapered surface to prevent occurrence of surface flaws and cracks in the second wire drawing step. Thus, making a surface roughness of a tapered surface 22*a* smaller than a surface roughness of a tapered surface 21*a* is advantageous in that it is possible to decrease only the particle size of the outer peripheral portion without producing surface flaws.

[7] Solution Heat Treatment (First Heat Treatment) and First Strain Processing

Subsequently, a solution heat treatment as well as first strain processing is applied to the work piece. This solution heat treatment is performed for a purpose such as dissolving Mg, Si compounds randomly contained in the work piece into a parent phase of an aluminum alloy. The first heat treatment is a heat treatment including heating to a predetermined temperature in a range of 480° C. to 620° C. and thereafter cooling at an average cooling rate of greater than or equal to 10° C./s to a temperature of at least to 150° C. When a solution heat treatment temperature is lower than 480° C., solution treatment will be incomplete, and acicular $Mg_2Si$ precipitates that precipitate during an aging heat treatment in a postprocessing decreases, and degrees of improvement of the proof stress, the tensile strength, the bending fatigue resistance, and the conductivity become smaller. When solution heat treatment is performed at a temperature higher than 620° C., the problem that crystal grains coarsens occurs and there is a possibility of a decrease in the proof stress, the tensile strength, the elongation, and the bending fatigue resistance. Also, since more elements other than aluminum are contained as compared to pure aluminum, a fusing point lowers and may melt partially. The solution heat treatment temperature described above is preferably in a range of 500° C. to 600° C., and more preferably in a range of 520° C. to 580° C.

A method of performing the first heat treatment may be, for example, batch heat treatment or may be continuous heat treatment such as high-frequency heating, conduction heating, and running heating, and it is advantageous to use continuous heat treatment in which heat treatment is performed by joule heat generated from a wire rod itself, such as high-frequency heating and conduction heating, since it has a greater tendency that the grain size at the outer peripheral portion is smaller than the grain size at an inner portion.

In a case where high-frequency heating and conduction heating are used, the wire rod temperature increases with a passage of time, since it normally has a structure in which electric current continues flowing through the wire rod. Accordingly, since the wire rod may melt when an electric current continues flowing through, it is necessary to perform heat treatment in an appropriate time range. In a case where running heating is used, since it is an annealing in a short time, the temperature of a running annealing furnace is usually set higher than a wire rod temperature. Since the wire rod may melt with a heat treatment over a long time, it is necessary to perform heat treatment in an appropriate time range. Also, all heat treatments require at least a predetermined time period in which Mg, Si compounds contained randomly in the work piece will be dissolved into a parent phase of an aluminum alloy. Hereinafter, the heat treatment by each method will be described.

The continuous heat treatment by high-frequency heating is a heat treatment by joule heat generated from the wire rod itself by an induced current by the wire rod continuously passing through a magnetic field caused by a high frequency. Steps of rapid heating and rapid cooling are included, and the wire rod can be heat-treated by controlling the wire rod temperature and the heat treatment time. The cooling is performed after rapid heating by continuously allowing the wire rod to pass through water or in a nitrogen gas atmosphere. This heat treatment time is 0.01 s to 2 s, preferably 0.05 s to 1 s, and more preferably 0.05 s to 0.5 s.

The continuous conducting heat treatment is a heat treatment by joule heat generated from the wire rod itself by allowing an electric current to flow in the wire rod that continuously passes two electrode wheels. Steps of rapid heating and rapid cooling are included, and the wire rod can be heat-treated by controlling the wire rod temperature and the heat treatment time. The cooling is performed after rapid heating by continuously allowing the wire rod to pass through water, atmosphere or a nitrogen gas atmosphere. This heat treatment time period is 0.01 s to 2 s, preferably 0.05 s to 1 s, and more preferably 0.05 s to 0.5 s.

A continuous running heat treatment is a heat treatment in which the wire rod continuously passes through a heat treatment furnace maintained at a high-temperature. Steps of rapid heating and rapid cooling are included, and the wire rod can be heat-treated by controlling the temperature in the heat treatment furnace and the heat treatment time. The cooling is performed after rapid heating by continuously allowing the wire rod to pass through water, atmosphere or a nitrogen gas atmosphere. This heat treatment time period is 0.5 s to 120 s, preferably 0.5 s to 60 s, and more preferably 0.5 s to 20 s.

The batch heat treatment is a method in which a wire rod is placed in an annealing furnace and heat-treated at a predetermined temperature setting and a setup time. The wire rod itself should be heated at a predetermined temperature for about several tens of seconds, but in industrial application, it is preferable to perform for more than 30 minutes to suppress uneven heat treatment on the wire rod. An upper limit of the heat treatment time is not particularly limited as long as coarsening of the crystal grains do not occur, but in industrial application, since productivity increases when performed in a short time, heat treatment is performed within ten hours, and preferably within six hours.

Also, the first strain processing which is performed before the solution heat treatment, during the solution heat treatment, or both produces a low strain at an outer peripheral portion of the work piece. Therefore, the outer peripheral portion comes to a state where more processing has been performed, and the grain size of the outer periphery becomes smaller after the solution treatment. This first strain processing is a process of deforming a work piece along a pulley through one or more pulleys having a diameter of 10 cm to 50 cm, and an amount of strain in the work piece at this time is 0.0006 to 0.0150. The amount of strain is obtained by dividing a radius of the work piece by a sum of twice the pulley radius and the radius of the work piece.

[8] Stranding Process

A plurality of the wire rods subjected to the solution heat treatment and the first strain processing are bundled and stranded together. This step may be just before or just after the solution heat treatment or may be after the aging heat treatment. In this embodiment, a stranding process is performed. However, the stranding process may be omitted, and an aging heat treatment described below may be applied to a solid wire rod subjected to a solution heat treatment and a first strain processing.

[9] Aging Heat Treatment (Second Heat Treatment) and Second Strain Processing

Thereafter, an aging heat treatment as well as a second strain processing is applied to a stranded wire rod. The aging heat treatment is conducted for a purpose such as precipitating acicular $Mg_2Si$ precipitates. The heating temperature in the aging heat treatment is 140° C. to 250° C. When the heating temperature is lower than 140° C., it is not possible to precipitate the acicular $Mg_2Si$ precipitates sufficiently, and strength, bending fatigue resistance and conductivity tends to lack. When the heating temperature is higher than 250° C., due to an increase in the size of the $Mg_2Si$ precipitate, the conductivity increases, but strength and bending fatigue resistance tends to lack. As for the heating time, the most suitable length of time varies with temperature. In order to improve strength and bending fatigue resistance, the heating time is preferably a long when the temperature is low and the heating time is short when the temperature is high. Considering the productivity, a short period of time is preferable, which is preferably 15 hours or less and further preferably 10 hours or less.

The second strain processing performed before the aging heat treatment produces a low strain in an outer peripheral portion of the wire rod. Therefore, deformation such as a squeeze causes a decrease in the grain size of the outer peripheral portion. When a processing strain is too large, an excessive processing will be applied, which leads to a decrease in the elongation. The second strain processing is a process of deforming the wire rod along a bobbin or a spool via one or a plural of bobbins or spools of 30 cm to 60 cm in diameter, and an amount of strain of the wire rod at this time is 0.0005 to 0.0050. The amount of strain is obtained by dividing a radius of the wire rod by a sum of twice the bobbin (spool) radius and the radius of the wire rod. Note that the bobbin or the spool as used herein is a member having a cylindrical outer edge and allows the wire rod to be wound up along the outer edge thereof.

(Aluminum Alloy Conductor According to the Present Disclosure)

A strand diameter of the aluminum alloy conductor of the present disclosure is not particularly limited and can be determined as appropriate depending on an application, and it is preferably ϕ0.1 mm to 0.5 mm for a fine wire, and ϕ0.8 mm to 1.5 mm for a case of a middle sized wire. As shown in a cross sectional view of FIG. 2, the present aluminum alloy conductor can be represented as a wire rod comprising an outer peripheral portion 31 formed in an aluminum alloy conductor 30 and an inner portion 32 that is a remaining portion other than the outer peripheral portion. Note that a value of a width of the outer peripheral portion 31 does not necessarily have to be 1/10 of the diameter and the aforementioned value can be within a certain range based on a technical concept of the present disclosure.

By making an average grain size at the outer peripheral portion 31 smaller, in other words, with a reduced average grain size only at the outer peripheral portion 31, a high conductivity, a high bending fatigue resistance, an appropriate proof stress and a high elongation can be achieved simultaneously. Further, by making the average grain size at the outer peripheral portion 31 smaller than the average grain size at an inner portion 32, such as by making the average grain size at the outer peripheral portion 31 to be a predetermined value within the aforementioned range and increasing the average grain size at the inner portion 32, it is possible to appropriately reduce the proof stress and improve the elongation with not much changes in the conductivity and the number of cycles to fracture. Specifically, it is preferable that the average grain size at the inner portion 32 is 1.1 times or more of the average grain size at the outer peripheral portion 31, and thereby the above effect can be positively achieved.

The aluminum alloy conductor and the aluminum alloy stranded wire according to the aforementioned embodiment were described above, but the present disclosure is not limited to the embodiment described above, and various alterations and modifications are possible based on a technical concept of the present disclosure.

For example, the aluminum alloy conductor or the aluminum alloy stranded wire is applicable to a coated wire having a coating layer at an outer periphery thereof. Also, it is applicable to a wire harness comprising a plurality of structures each including a coated wire and terminals attached to ends of the coated wire.

Also, a manufacturing method of an aluminum alloy conductor of the aforementioned embodiment is not limited to the embodiment described above, and various alterations and modifications are possible based on a technical concept of the present disclosure.

For example, although the range of the die half angle in the first wire drawing process is the same as the range of the die half angle in the second wire drawing process, the die half angle of the first wire drawing process may also be greater or smaller than the die half angle of the second wire drawing process. Also, although the range of the reduction ratio in the first wire drawing process is the same as the range of the reduction ratio in the second wire drawing process, the reduction ratio of the first wire drawing process may also be greater or smaller than the reduction ratio of the second wire drawing process.

Also, in the aforementioned embodiment, the first low strain processing is performed in during the solution heat treatment, but it may also be performed before the solution heat treatment. Also, the second low strain processing is performed during the aging heat treatment, but the second low strain processing does not need to be performed.

EXAMPLE

The present disclosure will be described in detail based on the following examples. Note that the present disclosure is not limited to examples described below.

Example I

Using a Properzi-type continuous casting rolling mill, molten metal containing Mg, Si, Fe and Al, and selectively added Cu, Zr, Ti and B with contents (mass %) shown in Table 1 is cast with a water-cooled mold and rolled into a bar of approximately ϕ9.5 mm. A casting cooling rate at this time was 1° C./s to 20° C./s. Then, a first wire drawing was carried out to obtain a reduction ratio shown in Table 2. Then, an intermediate heat treatment was performed on a work piece subjected to the first wire drawing, and thereafter, a second wire drawing was performed with a reduction ratio similar to the first wire drawing until a wire size of ϕ0.3 mm. Then, a solution heat treatment (first heat treatment) was applied under conditions shown in Table 2. In the solution heat treatment, in a case of a batch heat treatment, a wire rod temperature was measured with a thermocouple wound around the wire rod. In a case of continuous conducting heat treatment, since measurement at a part where the temperature of the wire rod is the highest is difficult due to the facility, the temperature was measured with a fiber optic radiation thermometer (manufactured by Japan Sensor Corporation) at a position upstream of a portion where the temperature of the wire rod becomes highest, and a maximum temperature was calculated in consideration of joule heat and heat dissipation. In a case of high-frequency heating and consecutive running heat treatment, a wire rod temperature in the vicinity of a heat treatment section outlet was measured. After the solution heat treatment, an aging heat treatment (second heat treatment) was applied under conditions shown in Table 2 to produce an aluminum alloy wire.

Example II

Except that Mg, Si, Fe and Al and selectively added Cu, Mn, Cr, Zr, Au, Ag, Hf, V, Ni, Sc, Co, Ti and B were combined with contents (mass %) shown in Table 3, casting and rolling were carried out with a method similar to that of Example I to form a rod of approximately ϕ9.5 mm. Then, the first wire drawing was performed to obtain a reduction ratio shown in Table 4. Then, an intermediate heat treatment was performed on a work piece subjected to the first wire drawing, and thereafter, a second wire drawing was performed with a reduction ratio similar to the first wire drawing until a wire size of ϕ0.3 mm. Then, a solution heat treatment (first heat treatment) was applied under conditions shown in Table 4. After the solution heat treatment, an aging heat treatment (second heat treatment) was applied under conditions shown in Table 4 to produce an aluminum alloy wire.

For each of aluminum alloy wires of the Example and the Comparative Example, each characteristic was measured by methods shown below. The results are shown in Tables 2 and 4.

(a) Average Grain Size

A longitudinal section of a material under test which was cut out in a wire drawing direction was filled with a resin and subjected to mechanical polishing, and thereafter subjected to electropolishing. This structure was captured with an optical microscope of a magnification of 200 to 400, and a particle size measurement was carried out by a tolerance method in conformity with JIS H0501 and H0502. In detail, a straight line parallel to the wire drawing direction was drawn in the captured image and the number of grain boundaries that cross the straight line was counted. Such measurement was carried out for each of an outer peripheral portion and an inner portion, such that the straight line crosses with about fifty grain boundaries, and the measurement was taken as an average grain size. Although it is preferable to have a longer straight line length, the measurement was carried out with the length and the number of the straight lines being adjusted in such a manner that, from the operability point of view, a grain size of about fifty crystal grains can be measured and by using a plurality of straight lines since a long straight line may extend beyond an imaging range of the optical microscope.

(b) Number of Cycles to Fracture

As a reference of the bending fatigue resistance, a strain amplitude at an ordinary temperature is assumed as ±0.17%. The bending fatigue resistance varies depending on the strain amplitude. In a case where the strain amplitude is large, a fatigue life decreases, and in a case where the strain amplitude is small, the fatigue life increases. Since the strain amplitude can be determined by a wire size of the wire rod and a radius of curvature of a bending jig, a bending fatigue test can be carried out with the wire size of the wire rod and the radius of curvature of the bending jig being set arbitrarily. With a reversed bending fatigue tester manufactured by Fujii Seiki Co., Ltd. (existing company Fujii Co., Ltd.) and using a jig that can give a 0.17% bending strain, a repeated bending was carried out and a number of cycles to fracture was measured. In the present examples, number of cycles to fracture of 100,000 times or more was regarded as acceptable.

(c) Measurement of Proof Stress (0.2% Proof Stress) and Flexibility (Elongation after Fracture)

In conformity with JIS Z2241, a tensile test was carried out for three materials under test (aluminum alloy wires) each time and a 0.2% proof stress was calculated using a prescribed permanent elongation of 0.2% by an offset method, and an average value thereof was obtained. The proof stress of greater than or equal to 50 MPa and less than or equal to 320 MPa was regarded as acceptable so as to withstand a load abruptly applied during an installation work to a car body and to avoid a decrease in a working efficiency during installation of the wire harness. As for the elongation, an elongation after fracture of greater than or equal to 5% was regarded as acceptable.

(d) Conductivity (EC)

In a constant temperature bath in which a test piece of 300 mm in length is held at 20° C. (±0.5° C.), a resistivity was measured for three materials under test (aluminum alloy wires) each time using a four terminal method, and an average conductivity was calculated. The distance between the terminals was 200 mm. The conductivity is not particularly prescribed, but those greater than or equal to 35% were regarded as acceptable. Note that the conductivity of greater than or equal to 45% IACS is particularly preferable.

TABLE 1

| | | COMPOSITION MASS % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAMPLE | 1 | 0.60 | 0.60 | 0.20 | 0.20 | | | | | | | | 0.10 | | | 0.010 | 0.005 | BALANCE |
| | 2 | 0.60 | 0.60 | 0.20 | 0.20 | | | | | | | | 0.10 | | | 0.010 | 0.005 | |
| | 3 | 0.60 | 0.60 | 0.20 | 0.20 | | | | | | | | 0.10 | | | 0.010 | 0.005 | |
| | 4 | 0.60 | 0.60 | 0.20 | 0.20 | | | | | | | | 0.10 | | | 0.010 | 0.005 | |
| | 5 | 0.60 | 0.60 | 0.20 | 0.20 | | | | | | | | 0.10 | | | 0.010 | 0.005 | |
| | 6 | 0.60 | 0.60 | 0.20 | 0.20 | | | | | | | | 0.10 | | | 0.010 | 0.005 | |
| | 7 | 0.60 | 0.60 | 0.20 | 0.20 | | | | | | | | 0.10 | | | 0.010 | 0.005 | |
| | 8 | 0.60 | 0.60 | 0.20 | 0.20 | | | | | | | | 0.10 | | | 0.010 | 0.005 | |
| | 9 | 0.60 | 0.60 | 0.20 | 0.20 | | | | | | | | 0.10 | | | 0.010 | 0.005 | |
| | 10 | 0.60 | 0.60 | 0.20 | 0.20 | | | | | | | | 0.10 | | | 0.010 | 0.005 | |
| | 11 | 0.60 | 0.60 | 0.20 | 0.20 | | | | | | | | 0.10 | | | 0.010 | 0.005 | |
| | 12 | 0.60 | 0.60 | 0.20 | 0.20 | | | | | | | | 0.10 | | | 0.010 | 0.005 | |
| | 13 | 0.60 | 0.60 | 0.20 | 0.20 | | | | | | | | 0.10 | | | 0.010 | 0.005 | |
| | 14 | 0.60 | 0.60 | 0.20 | 0.20 | | | | | | | | 0.10 | | | 0.010 | 0.005 | |
| | 15 | 0.60 | 0.60 | 0.20 | 0.20 | | | | | | | | 0.10 | | | 0.010 | 0.005 | |
| | 16 | 0.60 | 0.60 | 0.20 | 0.20 | | | | | | | | 0.10 | | | 0.010 | 0.005 | |
| | 17 | 0.60 | 0.60 | 0.20 | 0.20 | | | | | | | | 0.10 | | | 0.010 | 0.005 | |
| | 18 | 0.60 | 0.60 | 0.20 | 0.20 | | | | | | | | 0.10 | | | 0.010 | 0.005 | |
| | 19 | 0.60 | 0.60 | 0.20 | 0.20 | | | | | | | | 0.10 | | | 0.010 | 0.005 | |
| | 20 | 0.60 | 0.60 | 0.20 | 0.20 | | | | | | | | 0.10 | | | 0.010 | 0.005 | |
| | 21 | 0.60 | 0.60 | 0.20 | 0.20 | | | | | | | | 0.10 | | | 0.010 | 0.005 | |
| | 22 | 0.60 | 0.60 | 0.20 | 0.20 | | | | | | | | 0.10 | | | 0.010 | 0.005 | |
| | 23 | 0.60 | 0.60 | 0.20 | 0.20 | | | | | | | | 0.10 | | | 0.010 | 0.005 | |
| | 24 | 0.60 | 0.60 | 0.20 | 0.20 | | | | | | | | 0.10 | | | 0.010 | 0.005 | |
| | 25 | 0.60 | 0.60 | 0.20 | 0.20 | | | | | | | | 0.10 | | | 0.010 | 0.005 | |
| | 26 | 0.60 | 0.60 | 0.20 | 0.20 | | | | | | | | 0.10 | | | 0.010 | 0.005 | |
| | 27 | 0.60 | 0.60 | 0.20 | 0.20 | | | | | | | | 0.10 | | | 0.010 | 0.005 | |
| | 28 | 0.60 | 0.60 | 0.20 | 0.20 | | | | | | | | 0.10 | | | 0.010 | 0.005 | |
| | 29 | 0.60 | 0.60 | 0.20 | 0.20 | | | | | | | | 0.10 | | | 0.010 | 0.005 | |
| | 30 | 0.60 | 0.60 | 0.20 | 0.20 | | | | | | | | 0.10 | | | 0.010 | 0.005 | |
| | 31 | 0.60 | 0.60 | 0.20 | 0.20 | | | | | | | | 0.10 | | | 0.010 | 0.005 | |
| COMPARATIVE | 1 | 0.60 | 0.60 | 0.20 | 0.20 | | | | | | | | 0.10 | | | 0.010 | 0.005 | |
| EXAMPLE | 2 | 0.60 | 0.60 | 0.20 | 0.20 | | | | | | | | 0.10 | | | 0.010 | 0.005 | |

TABLE 1-continued

| | COMPOSITION MASS % | | | | | | | | | | | | | | | | |
|---|---|---|---|---|---|---|---|---|---|---|---|---|---|---|---|---|---|
| No. | Mg | Si | Fe | Cu | Mn | Hf | V | Sc | Co | Ni | Cr | Zr | Au | Ag | Ti | B | Al |
| 3 | 0.60 | 0.60 | 0.20 | 0.20 | | | | | | | | 0.10 | | | 0.010 | 0.005 | |
| 4 | 0.60 | 0.60 | 0.20 | 0.20 | | | | | | | | 0.10 | | | 0.010 | 0.005 | |

TABLE 2

| | No. | 1ST AND 2ND DRAWING PROCESS REDUCTION RATIO PER PASS % | 1ST AND 2ND DRAWING PROCESS DIE HALF ANGLE DEGREE | LOW STRAIN PROCESS BEFORE 1ST HEAT TREATMENT | LOW STRAIN PROCESS DURING 1ST HEAT TREATMENT | LOW STRAIN PROCESS BEFORE 2ND HEAT TREATMENT | 1ST HEAT TREATMENT CONDITION METHOD | 1ST HEAT TREATMENT CONDITION HEATING TEMP. ° C. | 1ST HEAT TREATMENT CONDITION HEATING TIME |
|---|---|---|---|---|---|---|---|---|---|
| EXAMPLE | 1 | 10 | 10 | YES | YES | NO | BATCH | 580 | 10 min |
| | 2 | 7 | 17 | NO | NO | NO | HIGH-FREQ. | 520 | 0.06 sec |
| | 3 | 4 | 25 | NO | NO | NO | HIGH-FREQ. | 480 | 0.06 sec |
| | 4 | 1 | 30 | NO | NO | NO | HIGH-FREQ. | 550 | 0.17 sec |
| | 5 | 10 | 10 | YES | NO | NO | CONDUCTION | 550 | 0.13 sec |
| | 6 | 7 | 16 | NO | NO | NO | CONDUCTION | 520 | 0.1 sec |
| | 7 | 4 | 30 | YES | YES | NO | HIGH-FREQ. | 620 | 0.5 sec |
| | 8 | 1 | 25 | NO | NO | NO | RUNNING | 580 | 10 sec |
| | 9 | 10 | 17 | NO | NO | NO | HIGH-FREQ. | 500 | 1 sec |
| | 10 | 7 | 10 | YES | YES | NO | RUNNING | 550 | 5 sec |
| | 11 | 4 | 24 | NO | NO | YES | BATCH | 580 | 80 min |
| | 12 | 1 | 30 | NO | NO | NO | CONDUCTION | 620 | 0.2 sec |
| | 13 | 10 | 10 | YES | NO | YES | BATCH | 580 | 60 min |
| | 14 | 7 | 17 | NO | YES | YES | BATCH | 480 | 60 min |
| | 15 | 4 | 25 | YES | NO | YES | BATCH | 580 | 60 min |
| | 16 | 1 | 30 | YES | YES | YES | CONDUCTION | 580 | 0.13 sec |
| | 17 | 10 | 10 | YES | YES | NO | BATCH | 580 | 30 min |
| | 18 | 7 | 17 | NO | NO | NO | BATCH | 520 | 10 min |
| | 19 | 4 | 35 | NO | NO | NO | BATCH | 550 | 60 min |
| | 20 | 1 | 30 | NO | NO | NO | HIGH-FREQ. | 580 | 0.1 sec |
| | 21 | 10 | 10 | NO | NO | NO | RUNNING | 620 | 1 sec |
| | 22 | 7 | 17 | NO | NO | NO | HIGH-FREQ. | 520 | 0.06 sec |
| | 23 | 4 | 25 | NO | NO | NO | BATCH | 550 | 30 min |
| | 24 | 1 | 30 | YES | YES | NO | BATCH | 580 | 60 min |
| | 25 | 10 | 30 | NO | NO | NO | CONDUCTION | 580 | 0.13 sec |
| | 26 | 7 | 17 | NO | NO | NO | HIGH-FREQ. | 480 | 0.2 sec |
| | 27 | 4 | 10 | NO | NO | NO | CONDUCTION | 580 | 1 sec |
| | 28 | 1 | 25 | NO | NO | NO | CONDUCTION | 580 | 0.5 sec |
| | 29 | 10 | 10 | NO | WO | NO | HIGH-FREQ. | 550 | 0.13 sec |
| | 30 | 7 | 17 | YES | YES | YES | BATCH | 620 | 60 min |
| | 31 | 4 | 25 | NO | NO | NO | BATCH | 550 | 30 min |
| COMPAR-ATIVE EXAMPLE | 1 | ***22*** | 10 | NO | NO | NO | BATCH | 580 | 30 min |
| | 2 | 10 | ***6*** | NO | NO | NO | BATCH | 580 | 50 min |
| | 3 | ***24*** | ***5*** | NO | NO | NO | BATCH | 600 | 30 min |
| | 4 | 10 | ***40*** | NO | NO | NO | BATCH | 640 | 60 min |

| | No. | 2ND HEAT TREATMENT CONDITION HEATING TEMP. ° C. | 2ND HEAT TREATMENT CONDITION HEATING TIME h | AVE. CRYSTAL GRAIN SIZE AT OUTER PERIPHERAL PORTION μm | AVE. CRYSTAL GRAIN SIZE AT INNER PORTION μm | NUMBER OF CYCLES TO FRACTURE ($\times 10^4$ CYCLES) | PROOF STRESS MPa | ELONGA-TION % | CONDUC-TIVITY (% IACS) |
|---|---|---|---|---|---|---|---|---|---|
| EXAMPLE | 1 | 175 | 5 | 34 | 45 | 20 | 70 | 7 | 47 |
| | 2 | 175 | 1 | 2 | 3 | 75 | 200 | 15 | 47 |
| | 3 | 175 | 15 | 1 | 2 | 129 | 314 | 12 | 50 |
| | 4 | 200 | 5 | 9 | 13 | 40 | 107 | 7 | 52 |
| | 5 | 200 | 10 | 8 | 10 | 55 | 180 | 8 | 52 |
| | 6 | 175 | 5 | 5 | 6 | 50 | 145 | 14 | 47 |
| | 7 | 140 | 1 | 14 | 21 | 27 | 92 | 15 | 47 |
| | 8 | 250 | 5 | 21 | 25 | 37 | 105 | 6 | 53 |
| | 9 | 225 | 10 | 6 | 7 | 42 | 121 | 6 | 55 |
| | 10 | 140 | 15 | 15 | 19 | 48 | 196 | 12 | 49 |
| | 11 | 175 | 15 | 34 | 49 | 80 | 265 | 5 | 49 |
| | 12 | 200 | 1 | 14 | 20 | 29 | 61 | 7 | 50 |
| | 13 | 175 | 15 | 35 | 49 | 73 | 260 | 5 | 50 |
| | 14 | 150 | 15 | 19 | 27 | 43 | 198 | 11 | 47 |

TABLE 2-continued

| | | | | | | | | | |
|---|---|---|---|---|---|---|---|---|---|
| | 15 | 150 | 5 | 31 | 49 | 23 | 73 | 9 | 46 |
| | 16 | 200 | 5 | 6 | 11 | 35 | 110 | 8 | 52 |
| | 17 | 200 | 15 | 35 | 46 | 10 | 50 | 5 | 53 |
| | 18 | 175 | 5 | 24 | 29 | 40 | 140 | 11 | 49 |
| | 19 | 150 | 15 | 32 | 42 | 70 | 230 | 8 | 48 |
| | 20 | 175 | 5 | 6 | 8 | 47 | 150 | 14 | 49 |
| | 21 | 150 | 1 | 22 | 24 | 26 | 88 | 16 | 48 |
| | 22 | 175 | 15 | 1 | 2 | 130 | 320 | 9 | 50 |
| | 23 | 175 | 10 | 25 | 32 | 61 | 210 | 14 | 50 |
| | 24 | 200 | 10 | 29 | 49 | 51 | 175 | 5 | 52 |
| | 25 | 200 | 5 | 10 | 13 | 39 | 105 | 8 | 52 |
| | 26 | 150 | 10 | 1 | 2 | 128 | 305 | 18 | 48 |
| | 27 | 200 | 5 | 17 | 20 | 37 | 91 | 15 | 53 |
| | 28 | 200 | 5 | 11 | 15 | 41 | 110 | 7 | 53 |
| | 29 | 150 | 15 | 7 | 8 | 77 | 249 | 13 | 48 |
| | 30 | 175 | 1 | 34 | 54 | 11 | 52 | 8 | 48 |
| | 31 | 200 | 5 | ***27*** | 35 | 55 | 100 | 5 | 52 |
| COMPAR- | 1 | 150 | 10 | ***37*** | 36 | ***7*** | 99 | 10 | 47 |
| ATIVE | 2 | 150 | 5 | ***39*** | 39 | ***5*** | 98 | 10 | 46 |
| EXAMPLE | 3 | 150 | 10 | ***41*** | 40 | ***4*** | 97 | 9 | 47 |
| | 4 | 150 | 5 | ***85*** | 47 | ***1*** | ***45*** | 4 | 46 |

N.B. NUMERICAL VALUES IN BOLD ITALIC IN THE TABLE ARE OUT OF APPROPRIATE RANGE OF THE EXAMPLE

TABLE 3

| | | COMPOSITION MASS % | | | | | | | | | | | | | | | | |
|---|---|---|---|---|---|---|---|---|---|---|---|---|---|---|---|---|---|---|
| | No. | Mg | Si | Fe | Cu | Mn | Hf | V | Sc | Co | Ni | Cr | Zr | Au | Ag | Ti | B | Al |
| EXAM- | 32 | 0.20 | 0.20 | 0.01 | 0.20 | 0.20 | | | | | | | 0.10 | | | 0.010 | 0.005 | BAL- |
| PLE | 33 | 0.30 | 0.30 | 0.10 | 0.10 | | | | | | | | | 0.50 | 0.50 | 0.010 | 0.005 | ANCE |
| | 34 | 0.40 | 0.40 | 0.20 | 0.30 | | | | | | | 0.30 | | | | | | |
| | 35 | 0.70 | 0.70 | 0.20 | | 0.05 | | | | | | | | | | 0.010 | 0.005 | |
| | 36 | 0.32 | 0.40 | 0.20 | | | | | | | | | | | | | | |
| | 37 | 0.80 | 0.80 | 0.30 | | | | | | | | | 0.20 | | | 0.010 | 0.005 | |
| | 38 | 0.60 | 0.60 | 0.01 | 0.50 | | | | | | | | | | | 0.010 | 0.005 | |
| | 39 | 0.10 | 0.80 | 0.20 | | | | | | | | 0.10 | | | | | | |
| | 40 | 0.30 | 0.60 | 0.10 | 0.20 | 0.30 | | | | | | | | | | 0.010 | 0.005 | |
| | 41 | 0.40 | 0.50 | 0.20 | 0.20 | | | | | | | | 0.30 | | | 0.010 | 0.005 | |
| | 42 | 0.55 | 0.55 | 0.20 | | | | | | | | | | | | | | |
| | 43 | 0.40 | 0.50 | 0.20 | | | | | | 0.05 | | | | | | 0.010 | 0.005 | |
| | 44 | 0.50 | 0.40 | 0.40 | | | | | | | | | | | | 0.010 | 0.005 | |
| | 45 | 0.70 | 0.30 | 0.25 | 0.10 | | | | | 0.20 | | | | | 0.10 | | | |
| | 46 | 0.80 | 0.10 | 0.20 | | 0.10 | | | | | | | 0.20 | | | 0.010 | 0.005 | |
| | 47 | 0.30 | 0.30 | 0.20 | | 0.50 | | | | | | | | | | | | |
| | 48 | 0.40 | 0.40 | 0.20 | | | 0.01 | 0.50 | | | | 0.50 | | | | | | |
| | 49 | 0.64 | 0.52 | 0.20 | | | | | | | | | 0.01 | | | | | |
| | 50 | 0.40 | 0.40 | 0.10 | | | | | 0.01 | | 0.50 | | | | | 0.020 | 0.010 | |
| | 51 | 0.50 | 0.50 | 0.10 | | | 0.50 | | | | | | | | | 0.020 | 0.010 | |
| | 52 | 0.60 | 0.60 | 0.10 | | | | | 0.50 | | | | | | | 0.020 | 0.010 | |
| | 53 | 0.60 | 0.60 | 0.10 | | | | 0.01 | | | 0.01 | | | | | 0.020 | 0.010 | |
| COMPAR- | 5 | ***0.01*** | 0.01 | 0.20 | 0.005 | 0.005 | | | | | | | | | | 0.010 | 0.005 | |
| ATIVE | 6 | 0.51 | 0.41 | 0.15 | | | | | | | | | 0.07 | | | 0.010 | 0.002 | |
| EXAM- | 7 | ***2.00*** | ***3.00*** | 0.20 | | | | | | | | | | | | 0.010 | 0.005 | |
| PLE | 8 | 0.55 | 0.55 | 0.20 | | | | | | | ***1.5*** | | | | | 0.010 | 0.005 | |
| | 9 | 0.55 | 0.55 | 0.20 | | ***1.5*** | | | | | | | | | | 0.010 | 0.005 | |
| | 10 | 0.55 | 0.55 | 0.20 | | | | | | | | | ***1.5*** | | | 0.010 | 0.005 | |
| | 11 | ***1.50*** | 0.60 | 0.20 | | | | | | | | ***1.2*** | | | | 0.010 | 0.005 | |
| | 12 | 0.67 | 0.52 | 0.40 | 0.20 | 0.20 | | | | | | | | | | 0.020 | 0.004 | |

N.B. NUMERICAL VALUES IN BOLD ITALIC IN THE TABLE ARE OUT OF APPROPRIATE RANGE OF THE EXAMPLE

TABLE 4

| | | 1ST AND 2ND DRAWING PROCESS | 1ST AND 2ND DRAWING PROCESS | LOW STRAIN PROCESS | LOW STRAIN PROCESS | LOW STRAIN PROCESS | 1ST HEAT TREATMENT CONDITION | | |
|---|---|---|---|---|---|---|---|---|---|
| | No. | REDUCTION RATIO PER PASS % | DIE HALF ANGLE DEGREE | BEFORE 1ST HEAT TREATMENT | DURING 1ST HEAT TREATMENT | BEFORE 2ND HEAT TREATMENT | METHOD | HEATING TEMP. ° C. | HEATING TIME |
| EXAMPLE | 32 | 1 | 30 | YES | YES | YES | CONDUCTION | 580 | 0.13 sec |
| | 33 | 1 | 30 | YES | YES | YES | CONDUCTION | 580 | 0.13 sec |
| | 34 | 1 | 30 | YES | YES | YES | CONDUCTION | 580 | 0.13 sec |

TABLE 4-continued

| | | | | | | | | | |
|---|---|---|---|---|---|---|---|---|---|
| | 35 | 1 | 30 | YES | YES | YES | CONDUCTION | 580 | 0.13 sec |
| | 36 | 1 | 30 | YES | YES | YES | CONDUCTION | 580 | 0.13 sec |
| | 37 | 1 | 30 | YES | YES | YES | CONDUCTION | 580 | 0.13 sec |
| | 38 | 1 | 30 | YES | YES | YES | CONDUCTION | 580 | 0.13 sec |
| | 39 | 1 | 30 | YES | YES | YES | CONDUCTION | 580 | 0.13 sec |
| | 40 | 4 | 25 | YES | NO | YES | BATCH | 580 | 60 min |
| | 41 | 4 | 25 | YES | NO | YES | BATCH | 580 | 60 min |
| | 42 | 4 | 25 | YES | NO | YES | BATCH | 580 | 60 min |
| | 43 | 4 | 25 | YES | NO | YES | BATCH | 580 | 60 min |
| | 44 | 4 | 25 | YES | NO | YES | BATCH | 580 | 60 min |
| | 45 | 4 | 25 | YES | NO | YES | BATCH | 580 | 60 min |
| | 46 | 4 | 25 | YES | NO | YES | BATCH | 580 | 60 min |
| | 47 | 4 | 25 | YES | NO | YES | BATCH | 580 | 60 min |
| | 48 | 4 | 25 | YES | NO | YES | BATCH | 580 | 60 min |
| | 49 | 1 | 30 | YES | YES | NO | BATCH | 580 | 60 min |
| | 50 | 1 | 30 | YES | YES | NO | BATCH | 580 | 60 min |
| | 51 | 1 | 30 | YES | YES | NO | BATCH | 580 | 60 min |
| | 52 | 1 | 30 | YES | YES | NO | BATCH | 580 | 60 min |
| | 53 | 1 | 30 | YES | YES | NO | BATCH | 580 | 60 min |
| COMPAR- | 5 | ***25*** | ***5*** | NO | NO | NO | CONDUCTION | 550 | 0.13 sec |
| ATIVE | 6 | ***30*** | ***3*** | NO | NO | NO | HIGH-FREQ. | 600 | 0.50 sec |
| EXAMPLE | 7 | 10 | 10 | NO | NO | NO | CONDUCTION | 580 | 0.13 sec |
| | 8 | 10 | 10 | NO | NO | NO | HIGH-FREQ. | 550 | 0.13 sec |
| | 9 | 10 | 10 | NO | NO | NO | CONDUCTION | 580 | 0.13 sec |
| | 10 | 10 | 10 | NO | NO | NO | HIGH-FREQ. | 550 | 0.13 sec |
| | 11 | ***20*** | ***40*** | WIRE BREAK DURING DRAWING | | | | | |
| | 12 | ***20*** | ***5*** | NO | NO | NO | BATCH | 530 | 3 h |

| | | 2ND HEAT TREATMENT CONDITION | | AVE. CRYSTAL GRAIN SIZE OF OUTER | AVE. CRYSTAL GRAIN SIZE | NUMBER OF CYCLES TO | | | |
|---|---|---|---|---|---|---|---|---|---|
| | No. | HEATING TEMP. ° C. | HEATING TIME h | PERIPHERAL PORTION μm | OF INNER PORTION μm | FRACTURE ($\times 10^4$ CYCLES) | PROOF STRESS MPa | ELONGA-TION % | CONDUC-TIVITY (% IACS) |
| EXAMPLE | 32 | 200 | 5 | 5 | 11 | 52 | 101 | 14 | 54 |
| | 33 | 200 | 5 | 5 | 10 | 64 | 132 | 12 | 50 |
| | 34 | 200 | 5 | 3 | 11 | 79 | 171 | 9 | 45 |
| | 35 | 200 | 5 | 7 | 13 | 109 | 248 | 5 | 54 |
| | 36 | 200 | 5 | 7 | 13 | 61 | 125 | 9 | 52 |
| | 37 | 200 | 5 | 3 | 12 | 121 | 280 | 5 | 45 |
| | 38 | 200 | 5 | 5 | 11 | 93 | 220 | 6 | 46 |
| | 39 | 200 | 5 | 3 | 11 | 53 | 103 | 14 | 45 |
| | 40 | 150 | 5 | 31 | 48 | 30 | 102 | 12 | 41 |
| | 41 | 150 | 5 | 31 | 49 | 34 | 115 | 13 | 45 |
| | 42 | 150 | 5 | 33 | 51 | 45 | 146 | 13 | 50 |
| | 43 | 150 | 5 | 32 | 50 | 38 | 136 | 14 | 51 |
| | 44 | 150 | 5 | 33 | 50 | 40 | 134 | 15 | 50 |
| | 45 | 150 | 5 | 31 | 49 | 36 | 120 | 11 | 50 |
| | 46 | 150 | 5 | 31 | 49 | 18 | 69 | 14 | 47 |
| | 47 | 150 | 5 | 31 | 48 | 28 | 93 | 16 | 40 |
| | 48 | 150 | 5 | 30 | 47 | 38 | 123 | 15 | 36 |
| | 49 | 200 | 10 | 31 | 51 | 53 | 155 | 7 | 55 |
| | 50 | 200 | 10 | 29 | 50 | 50 | 147 | 3 | 50 |
| | 51 | 200 | 10 | 30 | 49 | 83 | 131 | 8 | 49 |
| | 52 | 200 | 10 | 28 | 49 | 72 | 205 | 7 | 46 |
| | 53 | 200 | 10 | 31 | 50 | 73 | 206 | 7 | 51 |
| COMPAR- | 5 | 175 | 10 | 25 | 25 | ***6*** | 75 | 13 | 63 |
| ATIVE | 6 | 160 | 12 | ***40*** | 40 | ***9*** | 95 | 6 | 51 |
| EXAMPLE | 7 | 180 | 15 | 12 | 13 | ***5*** | ***370*** | ***0*** | 36 |
| | 8 | 150 | 15 | 7 | 8 | ***8*** | ***350*** | ***0*** | 37 |
| | 9 | 180 | 15 | 12 | 13 | ***1*** | ***330*** | 1 | ***33*** |
| | 10 | 150 | 15 | 7 | 8 | ***3*** | ***350*** | ***0*** | 35 |
| | 11 | WIRE BREAK DURING DRAWING | | | | | | | |
| | 12 | 160 | 8 | ***45*** | 45 | ***45*** | ***330*** | 3.0 | 50 |

N.B. NUMERICAL VALUES IN BOLD ITALIC IN THE TABLE ARE OUT OF APPROPRIATE RANGE OF THE EXAMPLE

The following is elucidated from the results indicated in Table 2.

Each of aluminum alloy wires of Examples 1 to 31 was capable of achieving a high conductivity, a high bending fatigue resistance, an appropriate proof stress and a high elongation simultaneously.

In contrast, in Comparative Example 1, a reduction ratio per pass and an average grain size at the outer peripheral portion were beyond the scope of the present disclosure, and under this condition, the number of cycles to fracture was insufficient. In Comparative Example 2, a die half angle and an average grain size at the outer peripheral portion were beyond the scope of the present disclosure, and the number of cycles to fracture was insufficient. In Comparative Example 3, a reduction ratio per pass, a die half angle and an average grain size at the outer peripheral portion were beyond the scope of the present disclosure and the number of cycles to fracture was insufficient. In Comparative Example 4, a die half angle and an average grain size at the outer periphery were beyond the scope of the present disclosure, and a number of cycles to fracture and a proof stress were insufficient.

Also, the following is elucidated from the results indicated in Table 4.

Each of aluminum alloy wires of Examples 32 to 54 was capable of achieving a high conductivity, a high bending fatigue resistance, an appropriate proof stress and a high elongation simultaneously.

In contrast, in Comparative Example 5 (pure aluminum), Mg, Si contents, a reduction ratio per pass and a die half angle were beyond the scope of the present disclosure and under this condition, the number of cycles to fracture was insufficient. In Comparative Example 6, a reduction ratio per pass, a die half angle and an average grain size at the outer peripheral portion were beyond the scope of the present disclosure and the number of cycles to fracture was insufficient. In Comparative Example 7, an Mg—Si content was beyond the scope of the present disclosure, and, the number of cycles to fracture and an elongation were insufficient, and a proof stress was excessive.

In Comparative Example 8, an Ni-content was beyond the scope of the present disclosure, and the number of cycles to fracture and an elongation were insufficient and a proof stress was excessive. In Comparative Example 9, an Mn-content was beyond the scope of the present disclosure, and the number of cycles to fracture and a conductivity were insufficient and a proof stress was excessive. In Comparative Example 10, a Zr-content was beyond the scope of the present disclosure, and the number of cycles to fracture and an elongation were insufficient and a proof stress was excessive.

In Comparative Example 11, an Mg content and a Cr content were beyond the scope of the present disclosure, and under this condition, a wire break occurred during the wire drawing. In Comparative Example 12, a reduction ratio per pass, a die half angle and an average grain size at the outer peripheral portion were beyond the scope of the present disclosure, and, the number of cycles to fracture and a proof stress were excessive. Note that Comparative Example 12 corresponds to sample No. 18 in Japanese Patent No. 5155464.

The aluminum alloy conductor of the present disclosure is composed of an Al—Mg—Si-based alloy, e.g., 6xxx series aluminum alloy, and an average grain size at an outer peripheral portion is configured to have a value in a predetermined range, and thus, particularly, even when used as an extra fine wire having a diameter of ϕ0.5 mm or smaller, it can be used as a wire rod for an electric wiring structure that shows a high conductivity, a high bending fatigue resistance, an appropriate proof stress and a high elongation. Also, it can be used for an aluminum alloy stranded wire, a coated wire, a wire harness, and the like, and it is useful as a battery cable, a harness or a lead wire for motor that are installed in transportation vehicles, and an electric wiring structure for industrial robots. Further, it can be preferably used in doors, a trunk, and an engine hood that require a high bending fatigue resistance.

What is claimed is:

1. An aluminum alloy wire rod having a composition consisting of Mg: 0.10 mass % to 1.00 mass %, Si: 0.10 mass % to 1.00 mass %, Fe: 0.01 mass % to 2.50 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein the aluminum alloy wire rod has an average grain size of 1 μm to 35 μm at an outer peripheral portion thereof, and an average grain size at an inner portion thereof is greater than or equal to 1.1 times the average grain size at the outer peripheral portion.

2. The aluminum alloy wire rod according to claim 1, wherein the composition contains at least one element selected from a group consisting of Ti: 0.001 mass % to 0.100 mass % and B: 0.001 mass % to 0.030 mass %.

3. The aluminum alloy wire rod according to claim 1, wherein the composition contains at least one element selected from a group consisting of Cu: 0.01 mass % to 1.00 mass %, Ag: 0.01 mass % to 0.50 mass %, Au: 0.01 mass % to 0.50 mass %, Mn: 0.01 mass % to 1.00 mass %, Cr: 0.01 mass % to 1.00 mass %, Zr: 0.01 mass % to 0.50 mass %, Hf: 0.01 mass % to 0.50 mass %, V: 0.01 mass % to 0.50 mass %, Sc: 0.01 mass % to 0.50 mass %, Co: 0.01 mass % to 0.50 mass %, and Ni: 0.01 mass % to 0.50 mass %.

4. The aluminum alloy wire rod according to claim 1, wherein a sum of contents of Fe, Ti, B, Cu, Ag, Au, Mn, Cr, Zr, Hf, V, Sc, Co, and Ni is 0.01 mass % to 2.50 mass %.

5. The aluminum alloy wire rod according to claim 1, wherein number of cycles to fracture measured in a bending fatigue test is greater than or equal to 100,000 cycles, and a conductivity is 45% to 55% IACS.

6. The aluminum alloy wire rod according to claim 1, wherein the aluminum alloy wire rod has a diameter of 0.1 mm to 0.5 mm.

7. An aluminum alloy stranded wire comprising a plurality of aluminum alloy wire rods as claimed in claim 6 which are stranded together.

8. A coated wire comprising a coating layer at an outer periphery of the aluminum alloy stranded wire as claimed in claim 7.

9. A coated wire comprising a coating layer at an outer periphery of the aluminum alloy wire rod as claimed in claim 6.

10. A method of manufacturing an aluminum alloy wire rod as claimed in claim 1, the aluminum alloy wire rod being obtained by carrying out a melting process, a casting process, hot or cold working, a first wire drawing process, an intermediate heat treatment, a second wire drawing process, a solution heat treatment and an aging heat treatment in this order, wherein, in the first wire drawing process, a die used has a die half angle of 10° to 30° and a reduction ratio per pass of less than or equal to 10%, and in the second wire drawing process, a die used has a die half angle of 10° to 30° and a reduction ratio per pass of less than or equal to 10%.

11. The method of manufacturing according to claim 10, wherein a strain processing that applies a low strain to an outer peripheral portion of a work piece is performed before the aging heat treatment.

12. The method of manufacturing according to claim 11, wherein the strain processing is performed during the solution heat treatment.

13. A wire harness comprising:

a coated wire including a coating layer at an outer periphery of one of an aluminum alloy wire rod and an aluminum alloy stranded wire; and a terminal fitted at an end portion of the coated wire, the coating layer being removed from the end portion, wherein the aluminum alloy wire rod has a composition consisting of Mg: 0.10 mass % to 1.00 mass %, Si: 0.10 mass % to 1.00 mass %, Fe: 0.01 mass % to 2.50 mass %, Ti: 0.000 mass % to 0.100 mass %, B: 0.000 mass % to 0.030 mass %, Cu: 0.00 mass % to 1.00 mass %, Ag: 0.00 mass % to 0.50 mass %, Au: 0.00 mass % to 0.50 mass %, Mn: 0.00 mass % to 1.00 mass %, Cr: 0.00 mass % to 1.00 mass %, Zr: 0.00 mass % to 0.50 mass %, Hf: 0.00 mass % to 0.50 mass %, V: 0.00 mass % to 0.50 mass %, Sc: 0.00 mass % to 0.50 mass %, Co: 0.00 mass % to 0.50 mass %, Ni: 0.00 mass % to 0.50 mass %, and the balance: Al and incidental impurities, wherein the aluminum alloy wire rod has an average grain size of 1 μm to 35 μm at an outer peripheral portion thereof, and an average grain size at an inner portion thereof is greater than or equal to 1.1 times the average grain size at the outer peripheral portion.

* * * * *